United States Patent [19]

Shimoyama et al.

[11] 4,338,143

[45] Jul. 6, 1982

[54] NON-ORIENTED SILICON STEEL SHEET WITH STABLE MAGNETIC PROPERTIES

[75] Inventors: Yoshiaki Shimoyama; Shigenobu Koga; Katsuyki Ohba, all of Kitakyushu, Japan

[73] Assignee: Nippon Steel Corporation, Tokyo, Japan

[21] Appl. No.: 248,419

[22] Filed: Mar. 27, 1981

[51] Int. Cl.[3] ..... C04B 35/00

[52] U.S. Cl. ..... 148/31.55; 75/123 B; 75/123 L; 75/123 E; 75/124

[58] Field of Search ..... 148/31.55; 75/123 B, 75/123 E, 123 G, 123 N, 123 L, 124 B, 124 C

[56] References Cited

U.S. PATENT DOCUMENTS 3,960,616 6/1976 Evans et al. ..... 148/110

4,043,805 8/1977 Hayami et al. ..... 75/123 L

*Primary Examiner*—John P. Sheehan

*Attorney, Agent, or Firm*—Wenderoth, Lind & Ponack

[57] ABSTRACT

A non-oriented silicon steel sheet with a low watt loss value as well as uniform magnetic properties which contains 1.5–3.5% Si, an exceedingly low C content, and a low soluble Al content, and has a ratio of B to N in the range of 0.4 to 2.0, and further contains at least one rare earth element.

3 Claims, 3 Drawing Figures

NON-ORIENTED SILICON STEEL SHEET WITH STABLE MAGNETIC PROPERTIES

I. BACKGROUND OF THE INVENTION

A. Field of the Invention

The present invention relates to a high-grade non-oriented silicon steel sheet, and more particularly, to a non-oriented silicon steel sheet excellent in magnetic properties which contains 1.5–3.5% Si, not more than 0.015% C, and not more than 0.08% acid-soluble Al (referred to as "sol Al" hereinafter), and which has B added thereto to obtain a balanced ratio of B to N and further contains a rare earth element.

B. Description of the Prior Art

Among silicon steel sheets constituting soft magnetic materials, there are the following kinds: a grain-oriented silicon steel sheet composed of a recrystallized collective texture crystallographically expressed as (110) [001] having its (110) plane on the rolling plane and its [001] orientation in the rolling direction; and a non-oriented silicon steel with negligible orientation. These materials are used for the iron cores of electrical devices chosen for specified applications in accordance with their properties (magnetic, mechanical etc.) and their production cost.

For instance, grain-oriented silicon steel sheet is generally used for transformers and pole transformers of large capacity regardless of its high cost because it has excellent magnetic properties. Namely, it is very easily magnetizable in the rolling direction, that is in the [001] direction, has a very low value of watt loss, and has very high permeability.

On the other hand, however, non-oriented silicon steel sheet is usually categorized into the following two kinds: low-grade non-oriented silicon steel sheet having a Si content between near zero and 1.5%, and high-grade non-oriented silicon steel sheet containing more than 1.5% Si. As these materials have an orientation so small as to be negligible and are low in cost, they are widely used for small-sized electric motors, medium-sized transformers, and medium-to-large-sized rotating machines.

A key property required of non-oriented silicon steel sheet is a low watt loss value. Watt loss consists chiefly of hysteresis loss and eddy current loss. In non-oriented silicon steel sheet, hysteresis loss is most effectively reduced by making the crystal grain size large and eddy current loss can be reduced by increasing the specific resistance of the steel, in other words by adding an alloying element such as Si or the like.

One means for enlarging the crystal grain size is by high-temperature annealing carried out over an extended period of time. This is, however, economically disadvantageous. Moreover, since continuous annealing is usually applied, long annealing times are difficult to obtain.

Inhibited growth of crystal grain size is known to be closely related to dispersed inclusions and precipitates. The size of the inclusions and precipitates and the state of their dispersion are very important. It is considered in general that the presence of many fine inclusions and precipitates is not beneficial for the growth of the crystal grains. As substances contained in dispersed phase in non-oriented silicon steel sheet, there can be mentioned various oxides, such as $Al_2O_3$, $SiO_2$ and the like, and various sulphides and nitrides, such as MnS and AlN.

As for the oxides, it is only necessary to collect and float them upwardly as deoxidized products in the steel making step and to prevent oxidizing at the time of casting the steel metal into ingot molds. Owing to recent progress in steel making techniques, inclusion of oxides can be easily prevented.

A widely used method for contending with sulphides is to thoroughly carry out desulphurizing in the steel making step while, at the same time, adding a suitable amount of Mn or the like, and then maintaining the heating temperature of the slab prior to the hot rolling step so low that the MnS can be converted to a substance harmless to the growth of the crystal grains. Because of the use of this method, sulphides do not pose a problem.

To hold down the inclusion of nitrides, it is best to keep the nitrogen content as low as possible in the steel making step. It is, however, very difficult to consistently reduce the nitrogen content in silicon steel to less than 10 ppm, and about 30 ppm of nitrogen is usually contained.

The combination of N with Al used for deoxidizing or with Al contained in a silicon alloy results in the formation of AlN. As an Al content in the range of 0.005–0.15% is injurious to the growth of the crystal grains, it has been usual in the production of low-grade non-oriented silicon steel sheet containing less than about 1.0–1.5% Si to reduce the Al used for deoxidizing as much as possible, preferably to less than 0.005%. Besides, in high-grade non-oriented silicon steel sheet containing more than about 1.0–1.5% Si, the Al content is controlled to be more than 0.15% and AlN is precipitated in a form harmless to the growth of the crystal grains when the steel slab is heated.

However, in the former case, there arise such troubles as insufficient deoxidation in the steel making step or the occurrence of defects on the surface of the steel sheet. In the latter case, production cost inevitably rises due to the consumption of a large quantity of expensive Al.

As an effective method for stabilizing deoxidation in the steel making process while avoiding the rise in cost caused by the use of large amounts of Al, the inventors previously developed an inexpensive method for manufacturing non-oriented silicon steel sheet having an excellent watt loss value by controlling the ratio of B to N to fall within the range of 0.5–2.50 by the addition of B. It has been found, however, that when steel sheet having a very low C content (0.015% or less) is produced by the method, the product is not entirely uniform in its magnetic properties.

II. SUMMARY OF THE INVENTION

Accordingly, it is one object of the present invention to provide a non-oriented silicon steel sheet with uniform magnetic properties which has its B content controlled to obtain a specific ratio of B to N and further contains at least one rare earth element.

Another object of this invention is to provide a non-oriented silicon steel sheet with uniform magnetic properties which contains 1.5–3.5% Si, an exceeding low C content, and a low soluble Al content, and has a ratio of B to N in the range of 0.4 to 2.0, and further contains at least one rare earth element.

Other objects of the invention will be better understood from the following detailed description with reference to the accompanying drawings.

III. BRIEF DESCRIPTION OF THE DRAWINGS

IV. DETAILED DESCRIPTION OF THE INVENTION

The present invention is directed to a non-oriented silicon steel sheet having uniform magnetic properties containing ≦0.015% C, 1.5–3.5% Si, 0.05–1.0% Mn, 0.005%–0.08% Sol Al, ≦0.015% S, ≦0.010% O, ≦0.005% N, B in an amount to obtain a ratio of B to N in the range of 0.4–2.0 and 0.001–0.02% of at least one rare earth element, the balance being Fe and unavoidable impurities.

The magnetic properties demanded of electric steel sheet as a magnetic material include both watt loss value (W15/50) and magnetic flux density B50. The non-oriented silicon steel sheet according to this invention is excellent in both these points exhibiting a watt loss value of 4.10 watt/Kg or less at 15000 gauss/50 cycle and a magnetic flux density B50 of more than 1.65 $w/m^2$.

Figure 1:
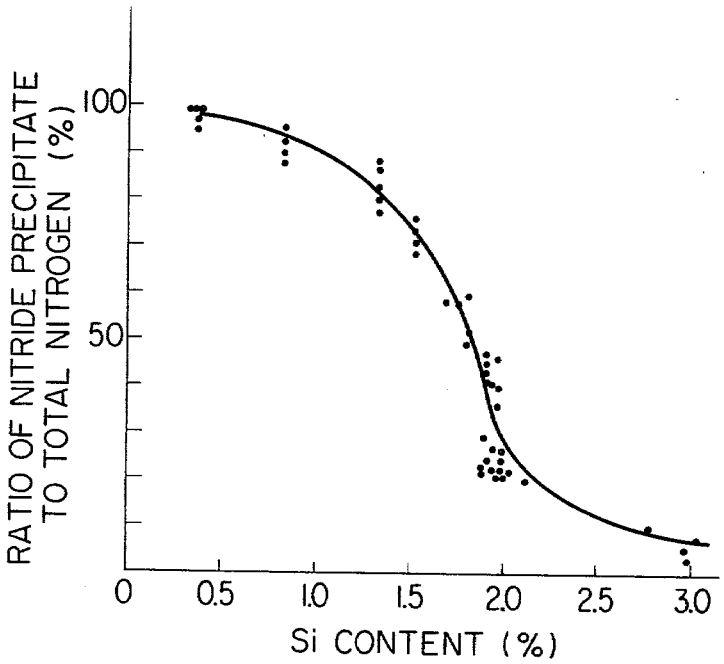
FIG. 1 is a diagram showing the relationship between the Si content and the ratio of precipitated nitride to total nitrogen.

As a result of detailed investigations conducted by the inventors on the precipitation behavior of nitride in the very low C zone (0.015% or less), it has been found that in steel containing 1.5% or more Si, particularly, 2.0% or more Si and 0.010% or less C, the amount of N precipitated as nitride in the hot rolled sheet is very small, as shown in FIG. 1.

FIG. 1 is the graph showing the relationship between the ratio (%) of nitride precipitate to the total nitrogen and the Si content (%). The chemical composition of the sample is such that C <0.010%, 0.008–0.050% sol Al, N <0.005%, and 0.0010–0.0050% B.

Thus, it was presumed that the insufficient precipitation of nitride in the hot-rolled steel sheet was the cause of the variation in watt loss value in the very low C zone.

On the basis of this presumption, the inventors conducted experiments which led to the discovery that the tendency toward slight variation in the watt loss value can be eliminated and the magnetic properties be made uniform by method which comprises adding B to silicon steel having a very low C content and a low sol Al content so as to bring the ratio of B to N within a specific range, and further, causing a small quantity of a rare earth element to coexist therewith.

The present invention will now be described in detail.

The steel used for producing a magnetic material in accordance with the invention is melted in a steel refining furnace, e.g. an electric furnace, an open hearth furnace, a converter or the like, and then, if required, is further refined in a vacuum refining furnace to reduce its C content to 0.015% or less, whereafter the required amounts of Al, Si Mn, B and rare earth element are added thereto.

The C content of the steel is controlled to be not more than 0.015% by decarburizing in the post-processing step since C exerts a deteriorative effect on the magnetic properties and magnetic ageing. If the C content exceeds 0.015%, the time required for decarburization will be prolonged, giving rise to an economical disadvantage.

The Si content is controlled in accordance with the required watt loss value. If the Si content exceeds 3.5%, however, the cold rolling property of the steel is deteriorated. As the present invention aims at the production of high-grade non-oriented silicon steel sheet, the Si content is specified as falling in the range of 1.5–3.5%.

Al is added to deoxidize the steel and a sol Al content of less than 0.005% results in insufficient deoxidation. Moreover, an insufficient sol Al content causes problems in the casting of ingots, results in an increase in sliver on the surface of the steel product, and causes poor yields of B and the rare earth element. Therefore, the Al content is specified as being not less than 0.005%. On the contrary, however, a large Al content will not only result in a cost increase but cancel out the effect of the addition of B and the rare earth element. Therefore, the Al content should be not more than 0.08%. The preferable range of the sol Al content is 0.015–0.050%.

Mn is added in an amount of not less than 0.05% in order to prevent brittle fracture in the hot rolling step and to compensate for the specific resistance of the steel due to the low content of Al so as to reduce this watt loss. On the other hand, the upper limit of Mn is set at 1.0% because the magnetic properties of the steel are degraded by an excessive Mn content.

As S is injurious to the magnetic properties, it is specified as being not more than 0.015% and preferably not more than 0.007%.

In general, since O acts to deteriorate the magnetic properties and induces useless consumption of B and the rare earth element, it is limited to not more than 0.010%.

If N exceeds 0.005%, it acts to deteriorate the magnetic properties and causes an economic disadvantage by increasing the required B content described hereinbelow. Hence the upper limit of the N content is fixed at 0.005%.

The B content of the steel is controlled to cause the ratio by weight of B to N to fall within a specific range. Namely the ratio by weight of B to N is specified as falling in the range of 0.4–2.0 since the watt loss increases when this ratio falls above or below this range. When the rare earth element described hereinbelow is also present, the preferred range of the B/N ratio from the point of reducing the watt loss is 0.6–1.5.

Another important element in addition to the above B is the rare earth element. Not less than 0.001% of at least one rare earth element is required in order to prevent the variation in magnetic properties observed to some extent in very low C-low sol Al silicon steel. If the content of the rare earth element exceeds 0.02%, the quantity of inclusions increases so much as to induce deterioration of the magnetic properties. Therefore, the content of the rare earth element is specified as falling in the range of 0.001–0.020%.

Figure 2:
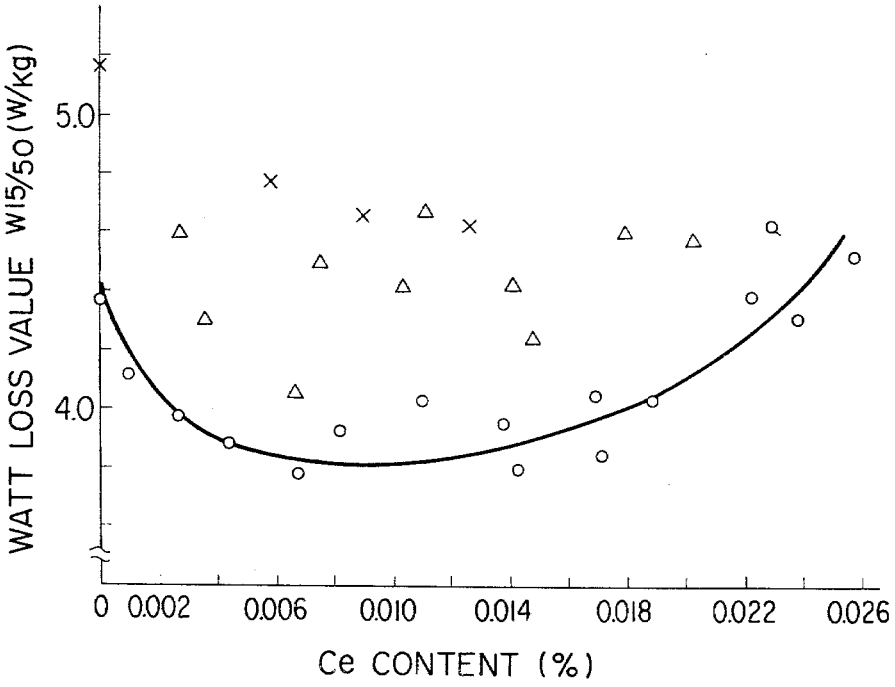
FIG. 2 is a graph showing the relationship between the Ce content and the watt loss value.

The results of an investigation conducted on the watt loss values of very low C-low sol Al silicon steels containing Ce as a rare earth element together with B are shown in FIG. 2.

In addition to Ce and B, the sample steels contained 0.003–0.008% C, 0.005–0.080% sol Al, and 2.2% Si.

In FIG. 2:

X indicates: No B added.

Δ indicates: B/N under 0.4 or above 2.0 o indicates: B/N in the range of 0.4–2.0.

As clearly shown in FIG. 2, the silicon steels which had a B/N ratio in the range of 0.4–2.0 and also contained Ce showed a low watt loss value. Particularly, the silicon steels with 0.001–0.020% Ce had a small watt loss value as well as excellent magnetic properties. The effect of the coexistence of B and Ce is remarkable in steels having a very low C content of not more than 0.005%.

On the contrary, however, the watt loss value was high in the case of silicon steels containing Ce alone or having a B/N ratio under 0.4 or above 2.0.

As the rare earth elements there can be used a mixture of metals having atomic numbers between 57 and 71. Mischmetal which contains about 50% Ce, the remainder being chiefly lanthanum and neodymium, is an inexpensive example falling in the class. Ce is preferred.

The addition of the rare earth element is effectively done at the time when deoxidizing has been fully carried out and the regulation of the composition has been completed.

In the present invention, a steel melt having controlled composition is cast to form a slab by the continuous casting process or is cast in a mold to form an ingot, which is further bloomed into a slab. Otherwise, a slab obtained by sizing rolling a continuous cast slab may be used.

The steel slab is usually heated to a temperature in the range of 1050° to 1250° C. in a heating furnace, and rolled to a thickness in the range of about 1.5 to 3.0 mm. After the oxidized surface layer of the hot-rolled sheet has been removed, it is rolled to the thickness of the final product. Then, the hot-rolled sheet may be subjected to annealing or to double cold-rolling, in which case annealing is performed between the two rolling operations, or to a combination of these steps.

The cold-rolled sheet is subjected to continuous annealing and coated with an insulating film to obtain a final product.

The method of casting the steel melt into a slab or ingot, and processing the slab or ingot may be selected in any way desired without departing from the spirit and object of the invention.

EXAMPLE 1

Steel slabs having the compositions shown in Table 1 were produced by preparing steel in a converter, refining it in a vacuum degassing vassel, and forming it into slabs by the continuous casting process. These slabs were heated to 1150° C. in a heating furnace, hot-rolled to 2.3 mm thickness subjected to annealing at 900° C. as required, pickled, and then cold-rolled to 0.5 mm thickness. Thereafter the cold-rolled sheets were subjected to annealing at 900° C. or 950° C. for the period of 60 seconds. The magnetic properties of an Epstein test sample of each of the above steels are shown in Table 2.

TABLE 1

| Sample No. | Classification | C % | Si % | Mn % | Sol Al% | S % | N % | B % | B/N | Ce % | O % |
|---|---|---|---|---|---|---|---|---|---|---|---|
| 1 | This invention | 0.003 | 2.20 | 0.25 | 0.025 | 0.007 | 0.0022 | 0.0020 | 0.91 | 0.004 | 0.003 |
| 2 | This invention | 0.004 | 2.22 | 0.30 | 0.065 | 0.007 | 0.0018 | 0.0030 | 1.67 | 0.008 | 0.002 |
| 3 | This invention | 0.003 | 2.15 | 0.41 | 0.028 | 0.006 | 0.0026 | 0.0020 | 0.77 | 0.014 | 0.002 |
| 4 | This invention | 0.003 | 2.25 | 0.66 | 0.018 | 0.007 | 0.0021 | 0.0030 | 1.43 | 0.017 | 0.004 |
| 5 | This invention | 0.004 | 2.88 | 0.30 | 0.022 | 0.005 | 0.0026 | 0.0022 | 0.85 | 0.005 | 0.002 |
| 6 | This invention | 0.005 | 2.93 | 0.62 | 0.043 | 0.005 | 0.0023 | 0.0031 | 1.35 | 0.009 | 0.002 |
| 7 | This invention | 0.003 | 2.92 | 0.22 | 0.032 | 0.004 | 0.0023 | 0.0020 | 0.87 | 0.016 | 0.002 |
| 8 | This invention | 0.004 | 2.83 | 0.18 | 0.044 | 0.004 | 0.0020 | 0.0024 | 1.20 | 0.011 | 0.002 |
| 9 | Reference material | 0.004 | 2.30 | 0.26 | 0.31 | 0.007 | 0.0026 | 0.0022 | 0.85 | 0.026 | 0.004 |
| 10 | Reference material | 0.004 | 2.16 | 0.20 | 0.022 | 0.006 | 0.0031 | — | — | 0.009 | 0.003 |
| 11 | Reference material | 0.003 | 2.27 | 0.36 | 0.024 | 0.007 | 0.0022 | 0.0022 | 1.00 | — | 0.002 |
| 12 | Reference material | 0.021 | 2.19 | 0.33 | 0.021 | 0.006 | 0.0033 | 0.0029 | 0.88 | 0.010 | 0.004 |
| 13 | Reference material | 0.004 | 3.01 | 0.22 | 0.033 | 0.004 | 0.0024 | 0.0020 | 0.83 | 0.024 | 0.002 |
| 14 | Reference material | 0.004 | 2.88 | 0.22 | 0.038 | 0.004 | 0.0026 | — | — | 0.013 | 0.002 |
| 15 | Reference material | 0.003 | 2.95 | 0.26 | 0.035 | 0.004 | 0.0023 | 0.0024 | 1.04 | — | 0.004 |
| 16 | Reference material | 0.025 | 2.83 | 0.21 | 0.041 | 0.004 | 0.0026 | 0.0020 | 0.77 | 0.008 | 0.002 |

TABLE 2

| Sample No. | Classification | Processes to which the sheet was subjected following hot rolling | Final annealing temperature | Magnetic properties W15/50 (W/kg) | Magnetic properties $B_{50}$ (T) |
|---|---|---|---|---|---|
| 1 | This invention | Pickling-Cold Rolling-Final Annealing | 900° C. | 3.89 | 1.67 |
| | This | | | | |

TABLE 2-continued

| Sample No. | Classification | Processes to which the sheet was subjected following hot rolling | Final annealing temperature | Magnetic properties W15/50 (W/kg) | Magnetic properties $B_{50}$ (T) |
|---|---|---|---|---|---|
| 2 | Invention | " | " | 3.95 | 1.66 |
| 3 | This invention | " | " | 3.98 | 1.65 |
| 4 | This invention | " | " | 4.05 | 1.66 |
| 5 | This invention | Annealing-Pickling-Cold Rolling-Final Annealing | 950° C. | 3.25 | 1.68 |
| 6 | This invention | " | " | 3.19 | 1.67 |
| 7 | This invention | " | " | 3.30 | 1.68 |
| 8 | This invention | " | " | 3.31 | 1.68 |
| 9 | Reference material | Pickling-Cold Rolling-Final Annealing | 900° C. | 4.52 | 1.66 |
| 10 | Reference material | " | " | 4.66 | 1.67 |
| 11 | Reference material | " | " | 4.18 | 1.66 |
| 12 | Reference material | " | " | 4.42 | 1.67 |
| 13 | Reference material | Annealing-Pickling-Cold Rolling-Final Annealing | 950° C. | 3.88 | 1.69 |
| 14 | Reference material | " | " | 3.94 | 1.69 |
| 15 | Reference material | " | " | 3.55 | 1.69 |
| 16 | Reference material | " | " | 3.69 | 1.68 |

Note:
T refers to TESLA.

EXAMPLE 2

Samples Nos. 3 and 11 of Example 1 were chosen for their very low C content and 20 hot-rolled sheets of each sample were prepared, subjected to pickling, cold rolling to 0.5 mm thickness, and then to annealing at 900° C. for 60 seconds. The average value of the watt loss and the variation therein was determined for the sheets.

Figure 3:
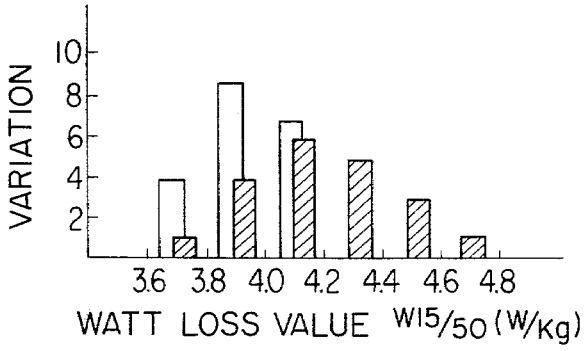
FIG. 3 is a diagram explaining the variation in watt loss values.

FIG. 3 is a diagram explaining the variation in watt loss values for samples Nos. 3 (white) and 11 (hatching).

As is clear from FIG. 3, the present invention is better than the reference in that watt loss values at W15/50 are concentrated in a narrow range between 3.6 and 4.0 W/kg.

Analytical values, average values of the watt loss, and the standard deviation of the samples are listed in Table 3.

TABLE 3

| Sample No. | Chemical Analytical Value (%) C | Si | Mn | Sol Al | S | N | B | B/N | Ce | Watt Loss Value (W/Kg) Average | Sample standard Deviation |
|---|---|---|---|---|---|---|---|---|---|---|---|
| 3 | 0.003 | 2.15 | 0.41 | 0.028 | 0.006 | 0.0026 | 0.0020 | 0.77 | 0.014 | 3.93 | 0.15 |
| 11 | 0.003 | 2.27 | 0.36 | 0.024 | 0.007 | 0.0022 | 0.0022 | 1.00 | — | 4.18 | 0.25 |

As is clear from the results of Examples 1 and 2, non-oriented silicon steel sheet having a low watt loss as well as small deviation can be manufactured by the present invention.

We claim:

1. A non-oriented silicon steel sheet having uniform magnetic properties characterized by possessing a watt loss value of 4.10 or less at 15000 gauss/50 cycle, and magnetic flux density B50 of at least 1.65 W/m$^2$, said sheet consisting essentially of ≦0.015% % C, 1.5–3.5% Si, 0.05–1.0% Mn, 0.005–0.08% acid-soluble Al, ≦0.015% S, ≦0.010% O, ≦0.005% N, B in such amount that the ratio of B to N is in the range of 0.4–2.0, 0.001–0.020% of at least one rare earth element, and the remainder of Fe and unavoidable impurities.

2. A non-oriented silicon steel sheet according to claim 1 containing of ≦0.005% C and 0.001–0.020% Ce.

3. A non-oriented silicon steel sheet according to claim 1 containing ≦0.010% C.

* * * * *